US011527844B2

(12) United States Patent
Chung et al.

(10) Patent No.: US 11,527,844 B2
(45) Date of Patent: Dec. 13, 2022

(54) ELECTRICAL CONNECTOR HAVING AN INSULATIVE BODY WITH PARTITION WALLS OF DIFFERENT EXTENT AND WITH SIDE WALLS PROVIDED WITH FIRST THROUGH FOURTH INSTALLATION GROOVES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chih-Ping Chung, New Taipei (TW); Kuei-Chung Tsai, New Taipei (TW); Chun-Hsiung Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/223,163

(22) Filed: Apr. 6, 2021

(65) Prior Publication Data

US 2021/0320448 A1 Oct. 14, 2021

(30) Foreign Application Priority Data

Apr. 8, 2020 (CN) ..... 202010269618.3

(51) Int. Cl.
*H01R 13/42* (2006.01)
*H01R 13/6471* (2011.01)
(Continued)

(52) U.S. Cl.
CPC ..... *H01R 13/42* (2013.01); *H01R 13/502* (2013.01); *H01R 13/6471* (2013.01); *H01R 24/60* (2013.01)

(58) Field of Classification Search
CPC .... H01R 13/42; H01R 13/502; H01R 13/506; H01R 13/6461; H01R 13/6471;
(Continued)

(56) References Cited

U.S. PATENT DOCUMENTS 6,354,875 B1 * 3/2002 Wu ..... H01R 13/658 439/108
8,764,464 B2 7/2014 Buck et al.
(Continued)

*Primary Examiner* — Marcus E Harcum
(74) *Attorney, Agent, or Firm* — Ming Chieh Chang

(57) ABSTRACT

An electrical connector includes an insulating body, a first terminal group having a signal terminal pair and a ground terminal arranged on one side of the signal terminal pair, each signal terminal having a tail portion, a contact portion, and a body portion, the body portion having a covering portion and a free portion exposed to air, wherein there is a first center distance between the contact portions of the signal terminal pair, there is a second center distance between the free portions, and there is a third center distance between the covering parts, and a second terminal group forming a first mating port with the first terminal group, wherein the second center distance is smaller than the first center distance, and the third center distance is greater than the second center distance.

8 Claims, 15 Drawing Sheets

(51) Int. Cl.
*H01R 13/502* (2006.01)
*H01R 24/60* (2011.01)

(58) Field of Classification Search
CPC ..... H01R 13/6473; H01R 13/6474; H01R 13/6476; H01R 13/6477; H01R 13/514; H01R 12/72; H01R 12/721; H01R 12/722; H01R 12/724; H01R 12/725; H01R 12/727; H01R 24/60
USPC ..... 439/634, 637, 941, 630, 632
See application file for complete search history.

(56) References Cited

U.S. PATENT DOCUMENTS 9,083,130 B2 7/2015 Casher et al.
9,337,585 B1 * 5/2016 Yang ..... H01R 13/6583
9,455,530 B2 * 9/2016 Patel ..... H01R 13/6471
9,478,884 B2 * 10/2016 Tsai ..... H01R 12/724
10,135,197 B2 * 11/2018 Little ..... H01R 12/58
10,381,767 B1 8/2019 Milbrand, Jr. et al.
10,396,513 B2 * 8/2019 Regnier ..... H01R 13/6581
10,581,201 B2 3/2020 Hsu et al.
10,741,971 B2 * 8/2020 Long ..... H01R 13/6471
10,855,020 B1 * 12/2020 Phillips ..... H01R 12/721
11,239,590 B2 * 2/2022 Yang ..... H01R 13/652
2008/0305689 A1 * 12/2008 Zhang ..... H01R 13/6585 439/638
2013/0171885 A1 * 7/2013 Zhang ..... H01R 13/6471 439/676
2015/0140866 A1 * 5/2015 Tsai ..... H01R 12/724 439/637
2016/0126677 A1 * 5/2016 Yu ..... H01R 13/6474 439/607.23
2017/0365954 A1 * 12/2017 Chen ..... H01R 24/60
2018/0115119 A1 * 4/2018 Little ..... H01R 12/00
2019/0097336 A1 * 3/2019 Toh ..... H01R 13/514
2020/0395698 A1 * 12/2020 Hou ..... H01R 13/6461
2021/0075164 A1 * 3/2021 Chen ..... H01R 13/6598

* cited by examiner

ELECTRICAL CONNECTOR HAVING AN INSULATIVE BODY WITH PARTITION WALLS OF DIFFERENT EXTENT AND WITH SIDE WALLS PROVIDED WITH FIRST THROUGH FOURTH INSTALLATION GROOVES

BACKGROUND OF THE INVENTION

1. Field of the Invention

The present invention relates generally to an electrical connector, and more particularly to an electrical connector suitable for transmitting high-speed signals and easy to assemble.

2. Description of Related Arts

U.S. Pat. No. 9,083,130 discloses an electrical connector comprising an insulating body and a terminal group housed in the insulating body. The terminal group includes a signal terminal pair and a ground terminal arranged on either side of the signal terminal pair. Characteristic impedance is tuned by adjusting parameters such as width and spacing of different portions of the contacts, but a change of the center distance between the terminals has a great impact on the transmission of high-speed signals. A width of the signal terminal and ground terminal also has a great impact on the transmission of high-speed signals. On the other hand, the size of the terminal is long and prone to be damaged during assembling to the housing.

An improved electrical connector is desired.

SUMMARY OF THE INVENTION

A main object of the present invention is to provide an electrical connector capable of transmitting high-speed signals and easy to assemble.

To achieve the above-mentioned object, an electrical connector for mating with a mating connector comprises: an insulating body; a first terminal group housed in the insulating body and including a first row of terminals and a first fixing member for fixing the first row of terminals, the first row of terminals including a signal terminal pair capable of transmitting differential signals and a ground terminal arranged on one side of the signal terminal pair, the signal terminal pair including a pair of signal terminals, each of the signal terminals including a tail portion, a contact portion for mating with the mating connector, and a body portion located between the tail portion and the contact portion, the body portion including a covering portion provided in the first fixing member and a free portion exposed to air, there being a first center distance between the contact portions of the signal terminal pair, there being a second center distance between the free portions of the body portions, there being a third center distance between the covering parts of the body portions; and a second terminal group housed in the insulating body and including a second row of terminals, the first row of terminals and the second row of terminals forming a first mating port; wherein the second center distance is smaller than the first center distance, and the third center distance is greater than the second center distance.

To achieve the above-mentioned object, an electrical connector for mating with a mating connector comprises: an insulating body; a first terminal group housed in the insulating body and including a first row of terminals and a first fixing member for fixing the first row of terminals, the first row of terminals including a signal terminal pair capable of transmitting differential signals and a ground terminal arranged on one side of the signal terminal pair, the signal terminal pair including a pair of signal terminals, each of the signal terminals including a tail portion, a contact portion for mating with the mating connector, and a body portion located between the tail portion and the contact portion, the body portion including a covering portion provided in the first fixing member and a free portion exposed to air, the ground terminal including a tail portion, a contact portion for mating with the mating connector, and a body portion located between the tail portion and the contact portion; and a second terminal group housed in the insulating body and including a second row of terminals, the first row of terminals and the second row of terminals forming a first mating port; wherein a width dimension of the free portion of the signal terminal body portion is at least twice a width dimension of the ground terminal body portion.

To achieve the above-mentioned object, an electrical connector for mating with a mating connector comprises: an insulating body including a body portion and an upper cover matched with the body portion, the body portion including a front side facing the mating connector at the front and a rear side opposite to the front side; a first terminal group housed in the insulating body, a second terminal group housed in the insulating body, the first terminal group and the second terminal group forming a first mating port; a third terminal group housed in the insulating body; and a forth terminal group housed in the insulating body, the third terminal group and the fourth terminal group forming a second mating port; the first mating port and the second mating port being arranged in a front-to-rear direction for mating to the mating connector, the size of the first terminal group along a lengthwise direction is larger than the size of either one of the second terminal group, the third terminal group, and the fourth terminal group; wherein the first terminal group and the upper cover are first assembled together and then installed forwardly in the body portion from the rear side.

Compared to the prior art, in the electrical connector of the present invention, the second center distance is smaller than the first center distance, and the third center distance is greater than the second center distance; the width dimension of the free portion of the body portion is at least twice the width dimension of the grounding body portion; the first terminal group and the upper cover are first assembled together and then installed in the body portion from the rear side forward, enabling it to meet the characteristic impedance of high-speed signal transmission and easy to assemble.

DETAILED DESCRIPTION OF THE PREFERRED EMBODIMENT

Figure 1:
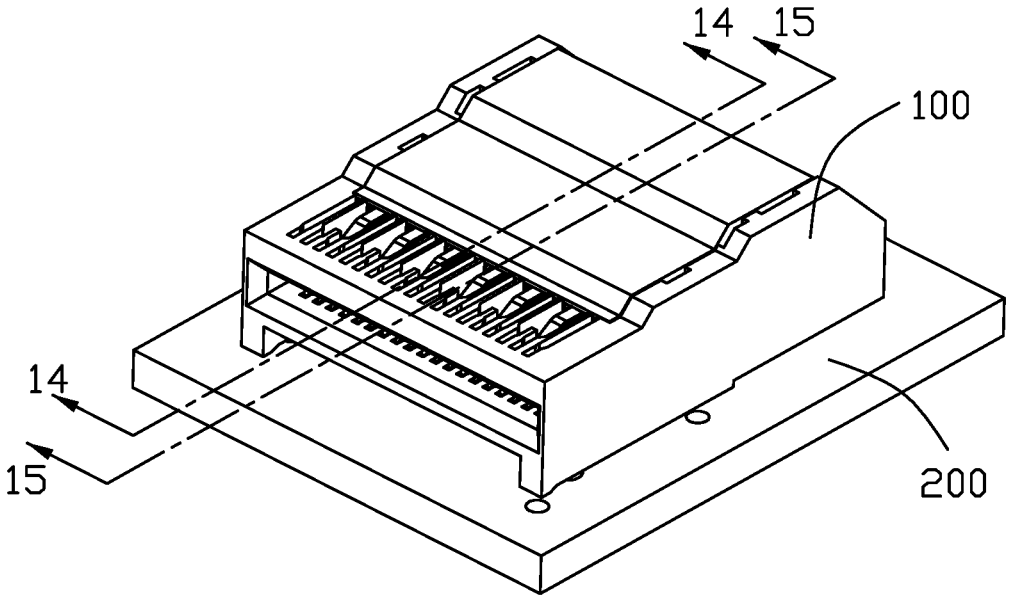
FIG. 1 is a perspective view of an electrical connector in accordance with the present invention and a circuit board matched with the electrical connector.
Figure 2:
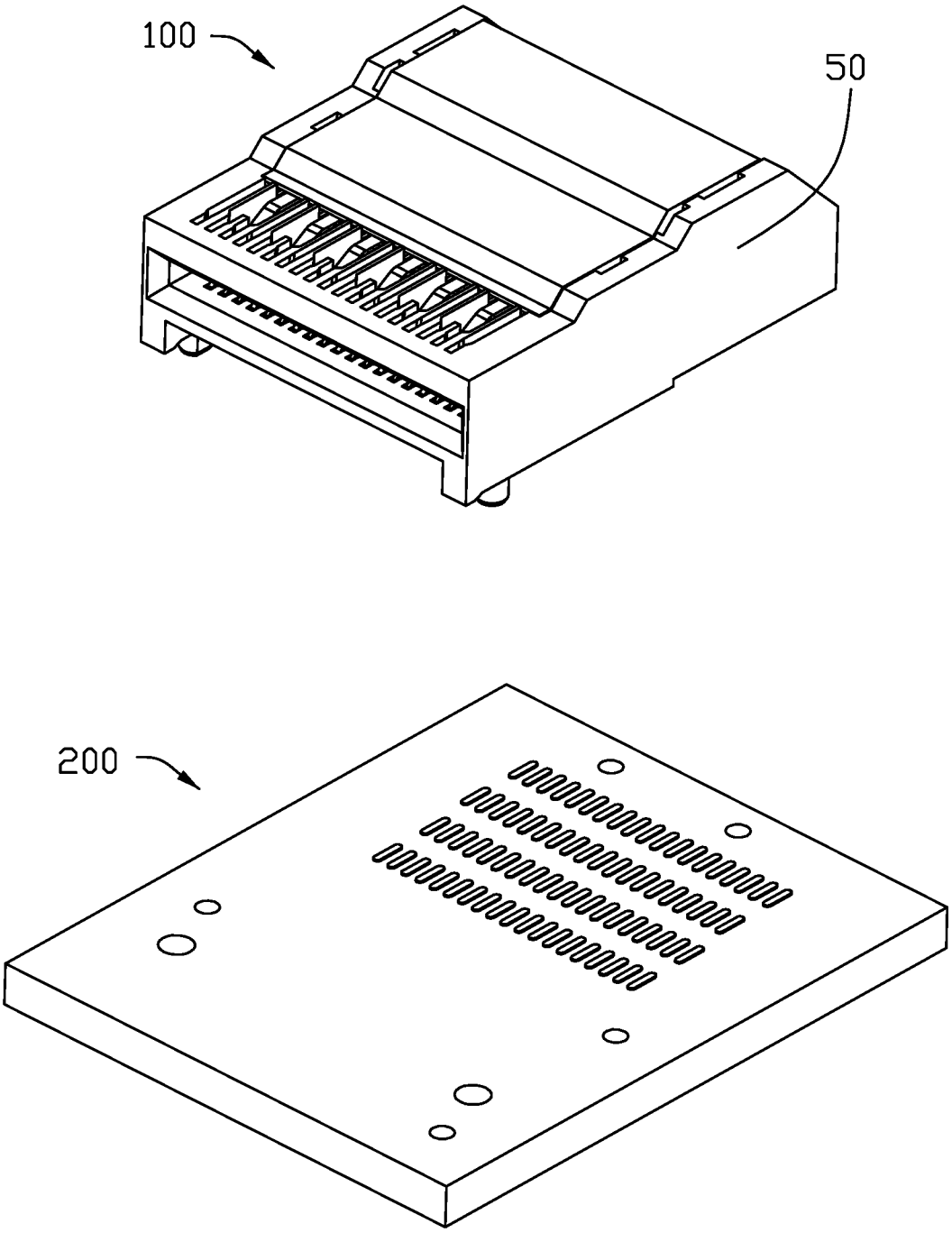
FIG. 2 is another perspective view of the electrical connector and the circuit board in FIG. 1.
Figure 3:
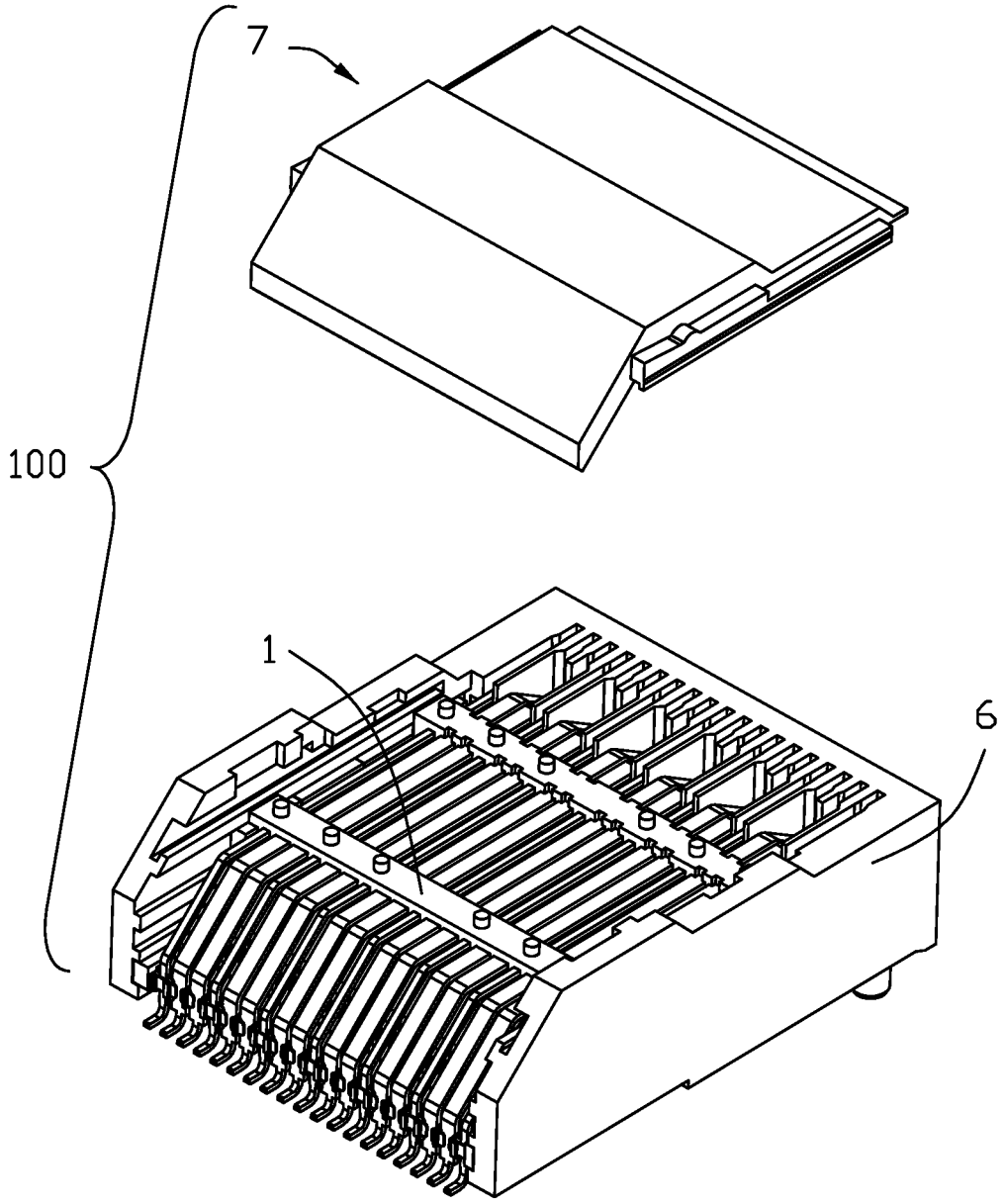
FIG. 3 is a partial exploded view of the electrical connector in FIG. 1.
Figure 4:
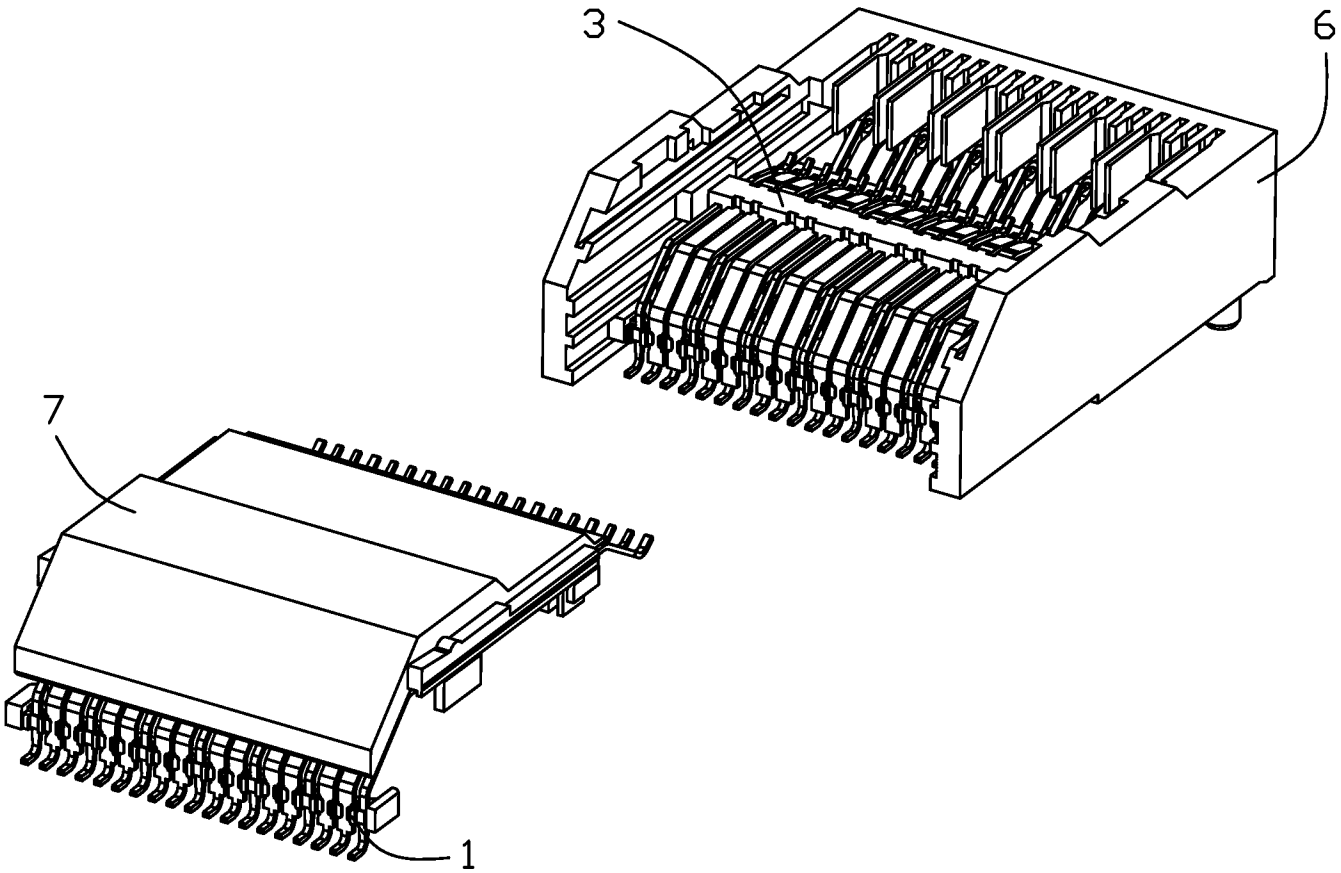
FIG. 4 is another partial exploded view of the electrical connector in FIG. 3.
Figure 5:
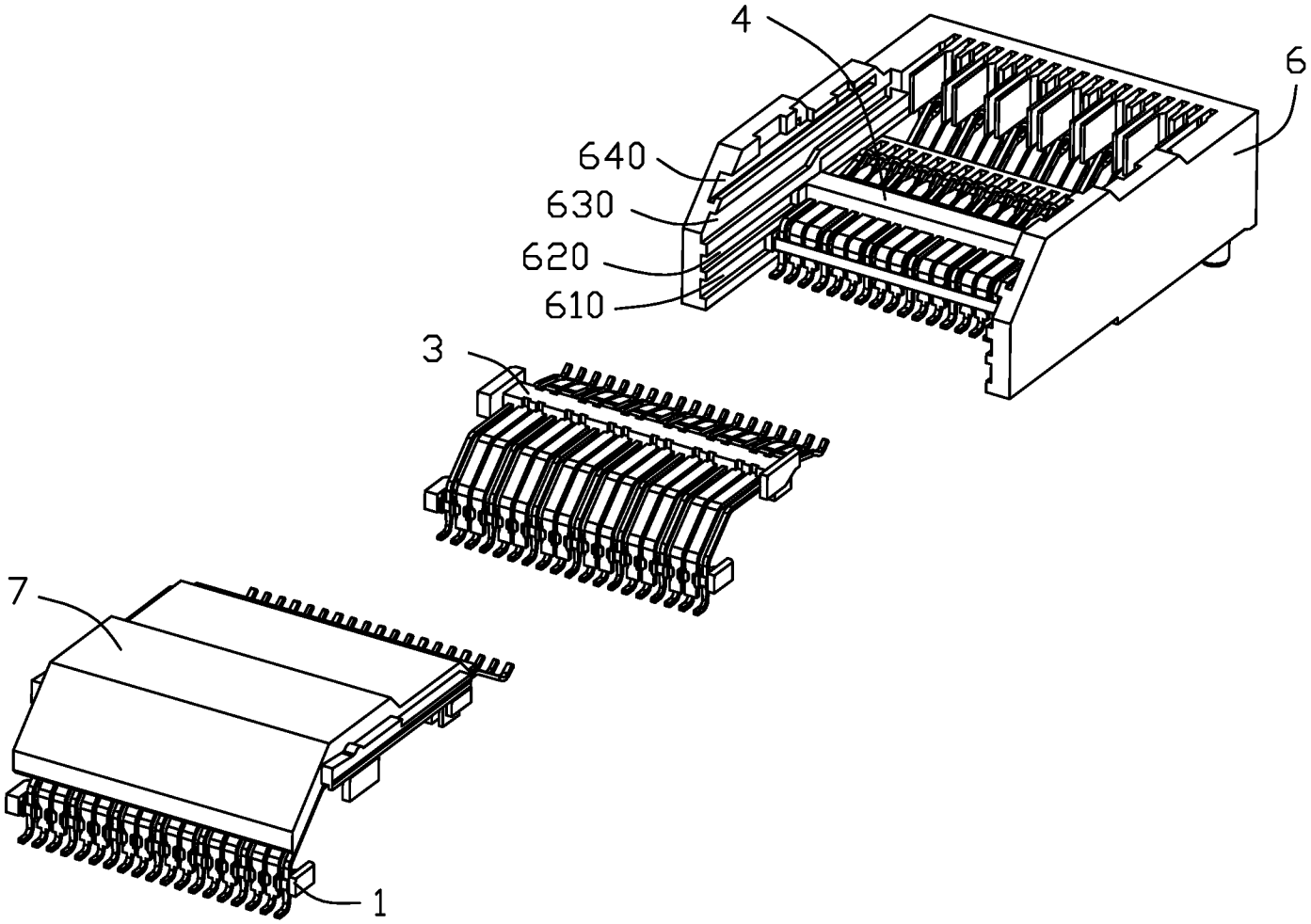
FIG. 5 is a further exploded view of the electrical connector in FIG. 4.
Figure 6:
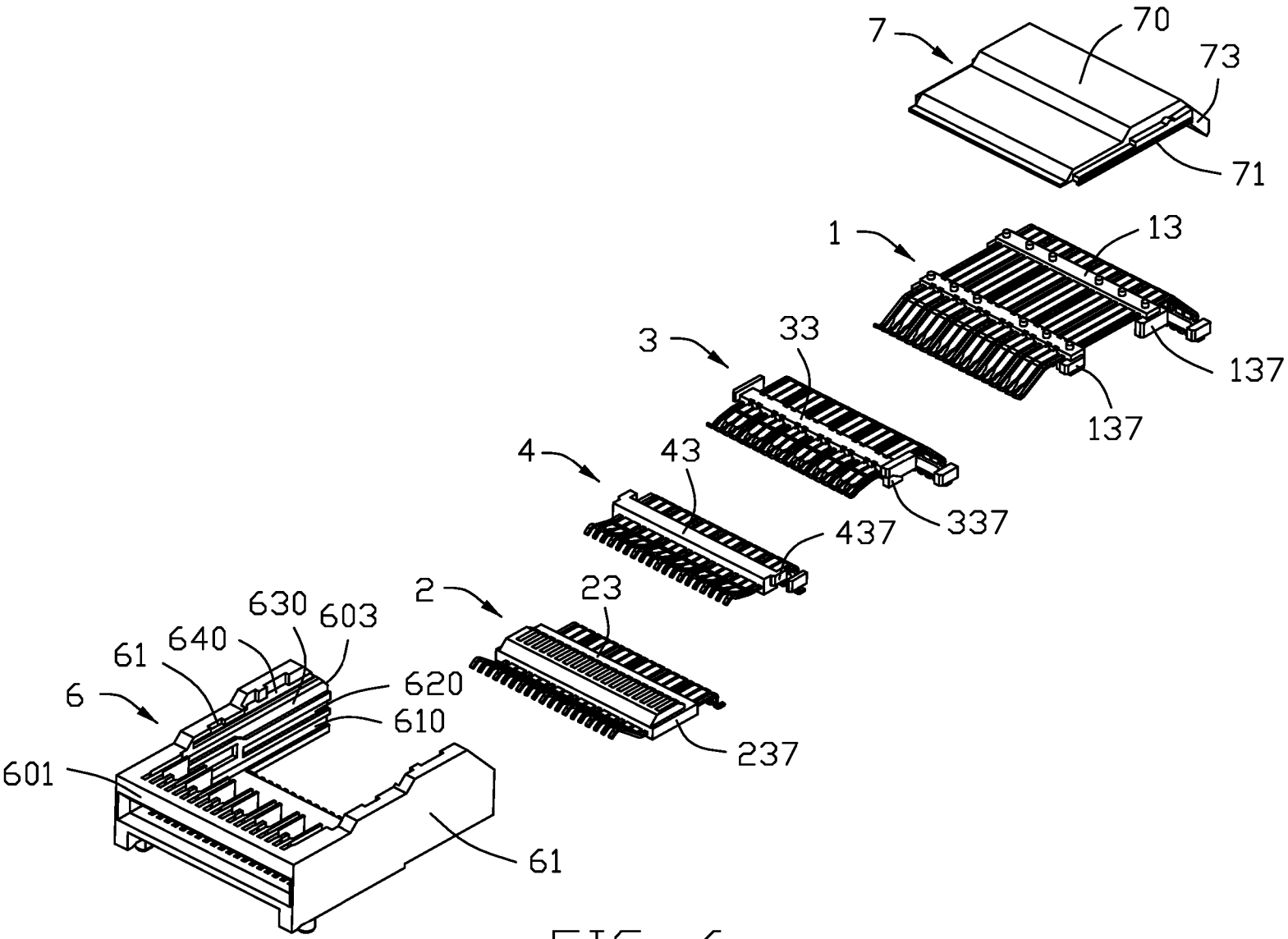
FIG. 6 is a further exploded view of the electrical connector in FIG. 5.
Figure 7:
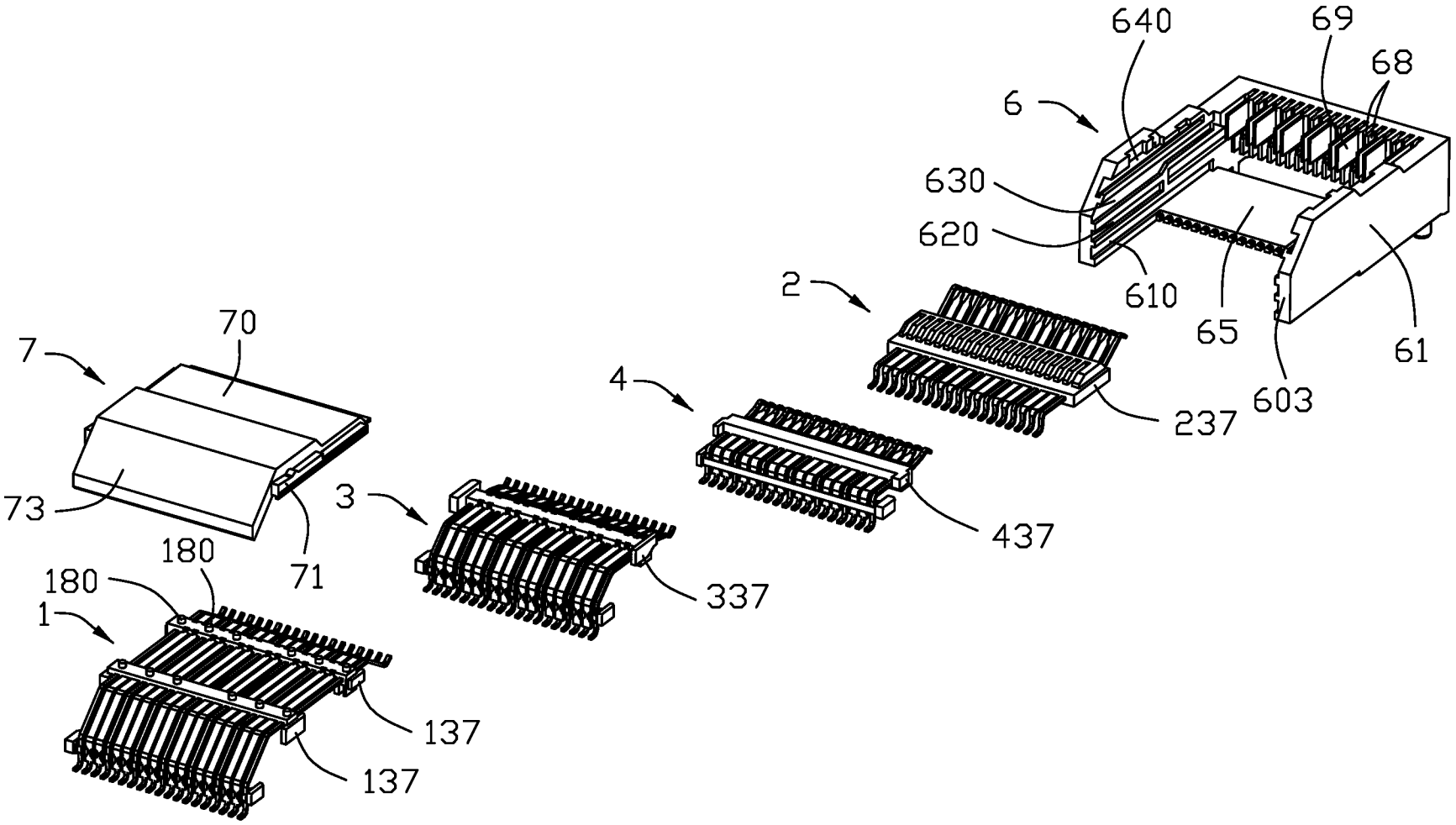
FIG. 7 is a another exploded view of the electrical connector in FIG. 6.
Figure 8:
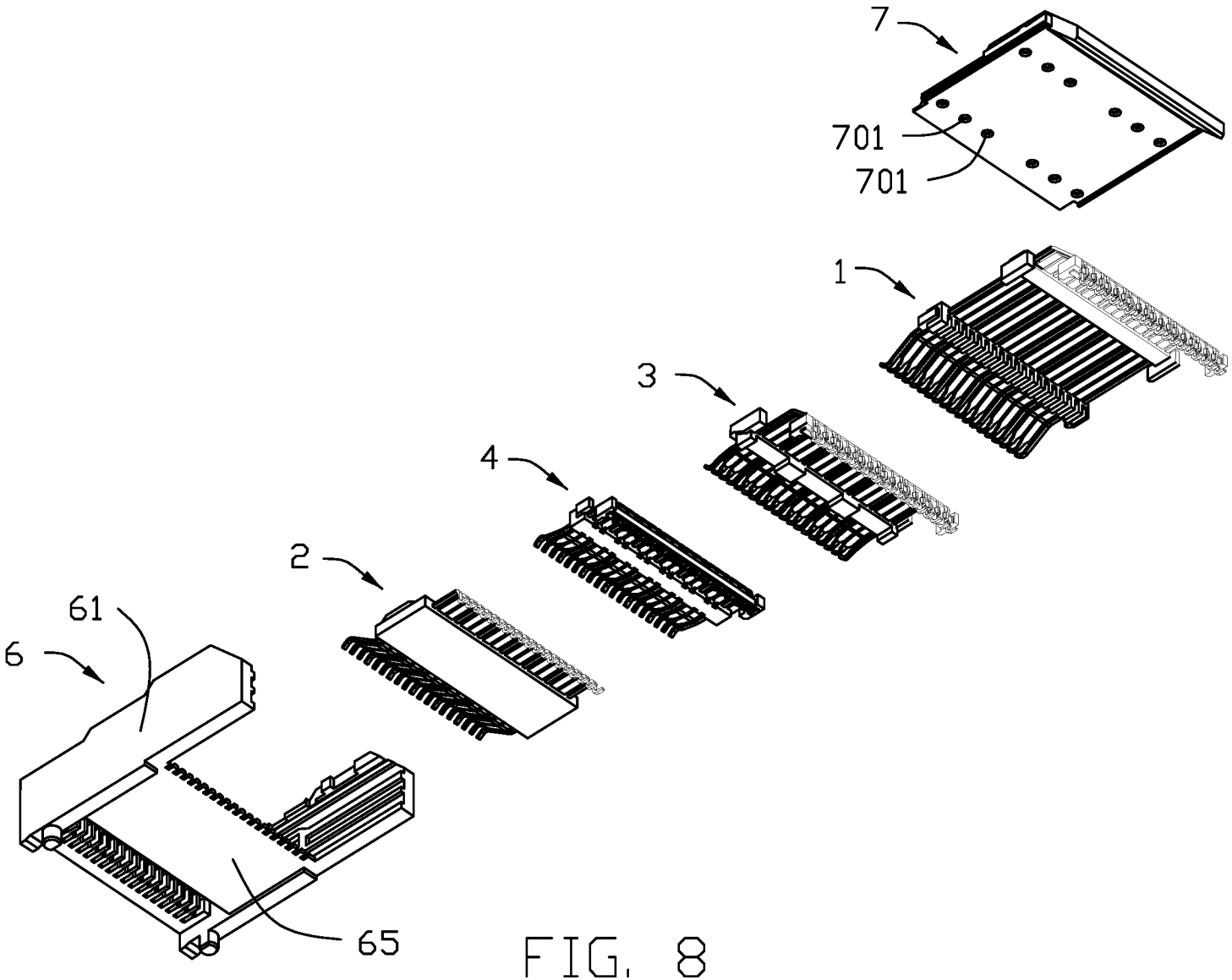
FIG. 8 is another exploded view of the electrical connector in FIG. 7.
Figure 9:
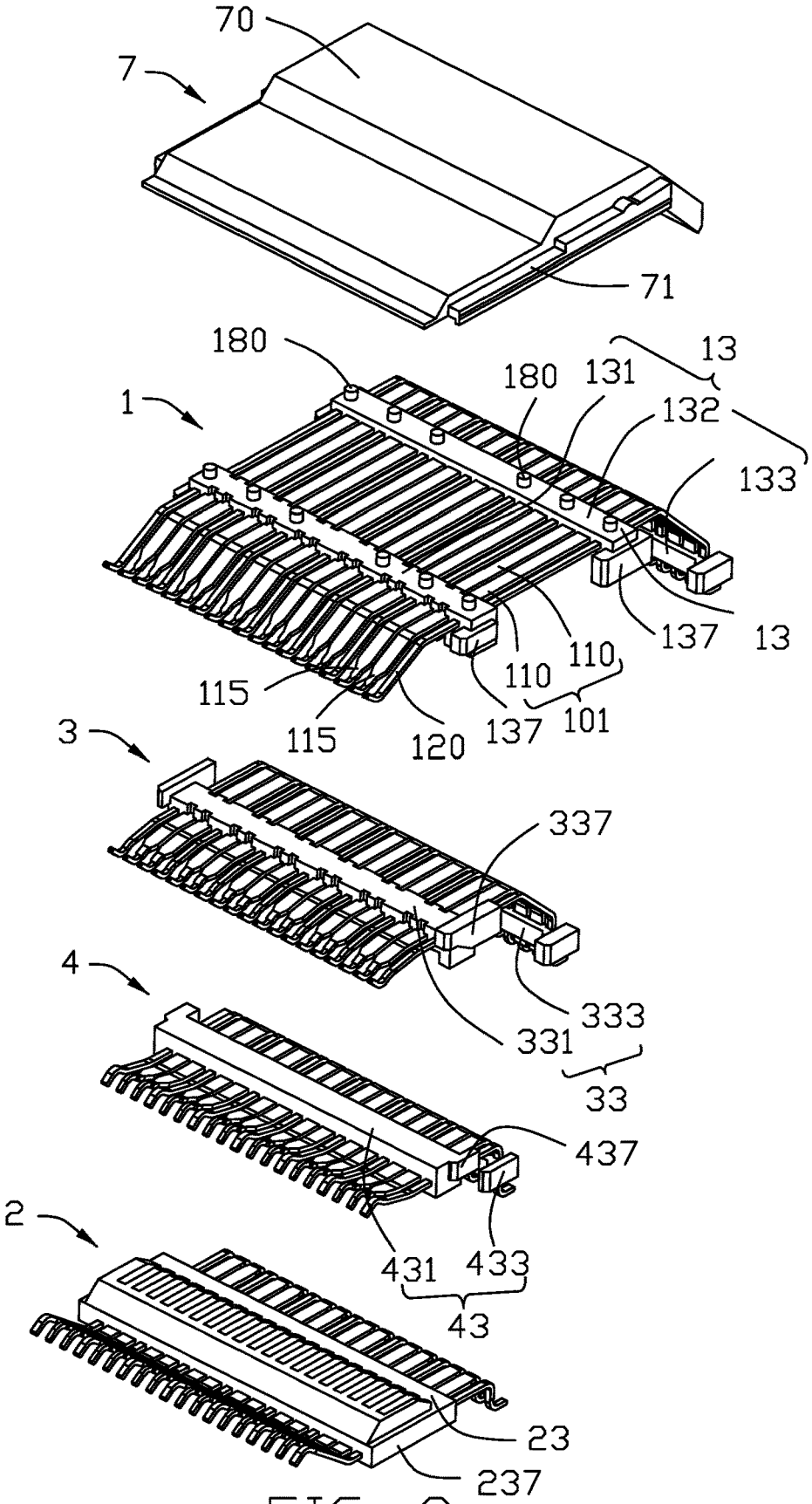
FIG. 9 is a perspective view of the terminal groups and the upper cover of the electrical connector in FIG. 6.
Figure 10:
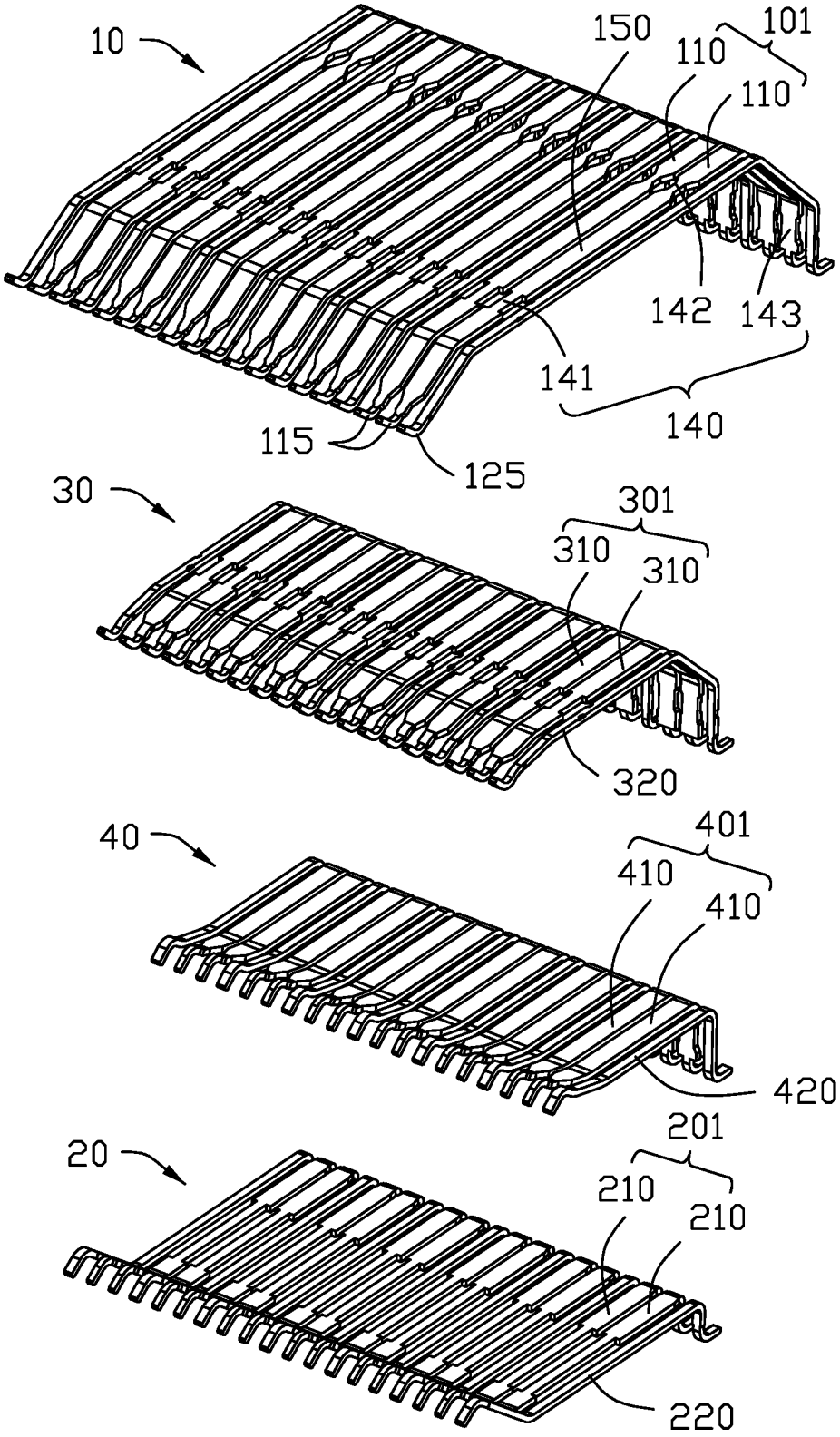
FIG. 10 is a perspective view of the four rows of terminals of the electrical connector in FIG. 9.
Figure 11:
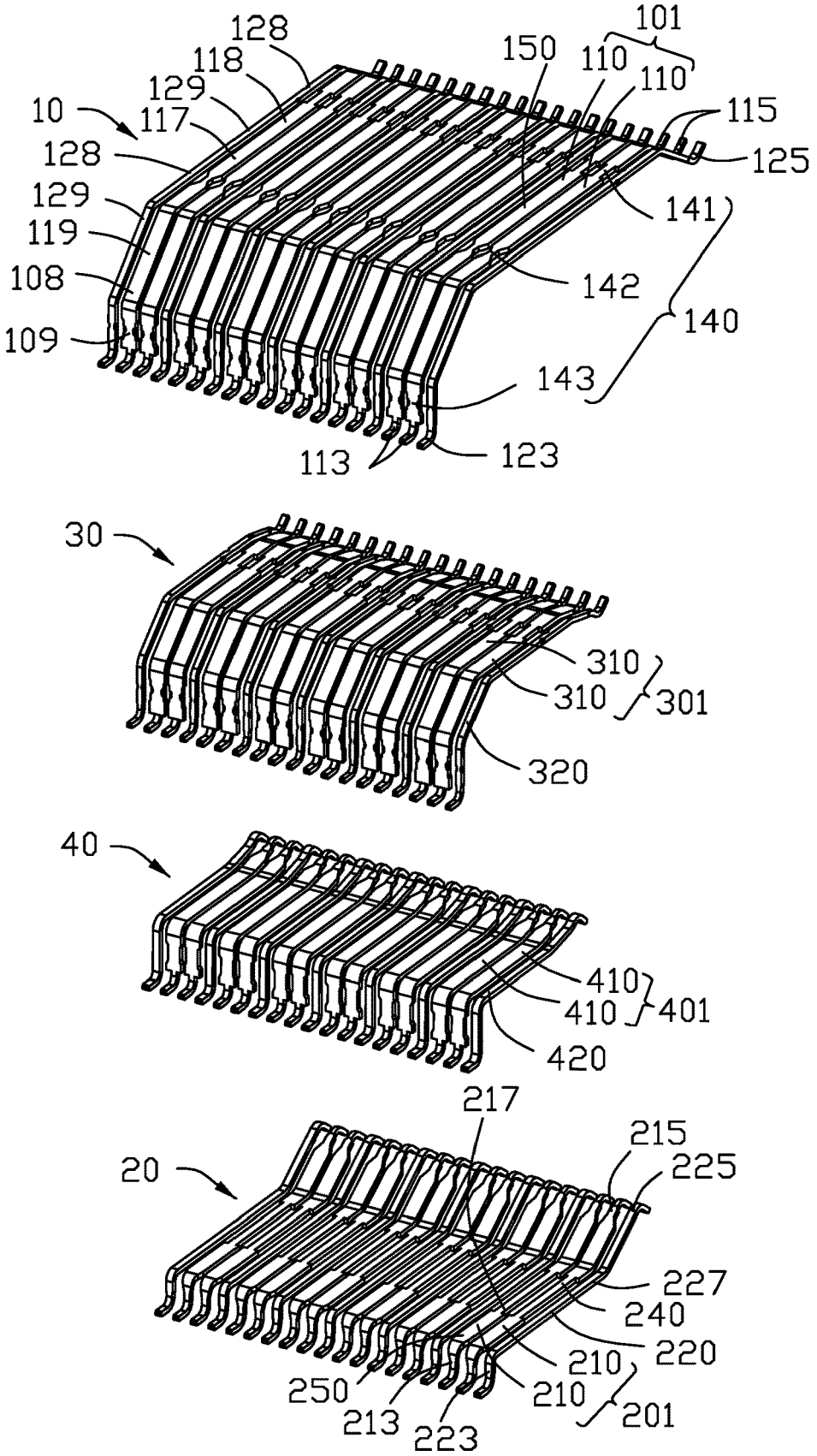
FIG. 11 is a another perspective view of the four rows of terminals in FIG. 9.
Figure 12:
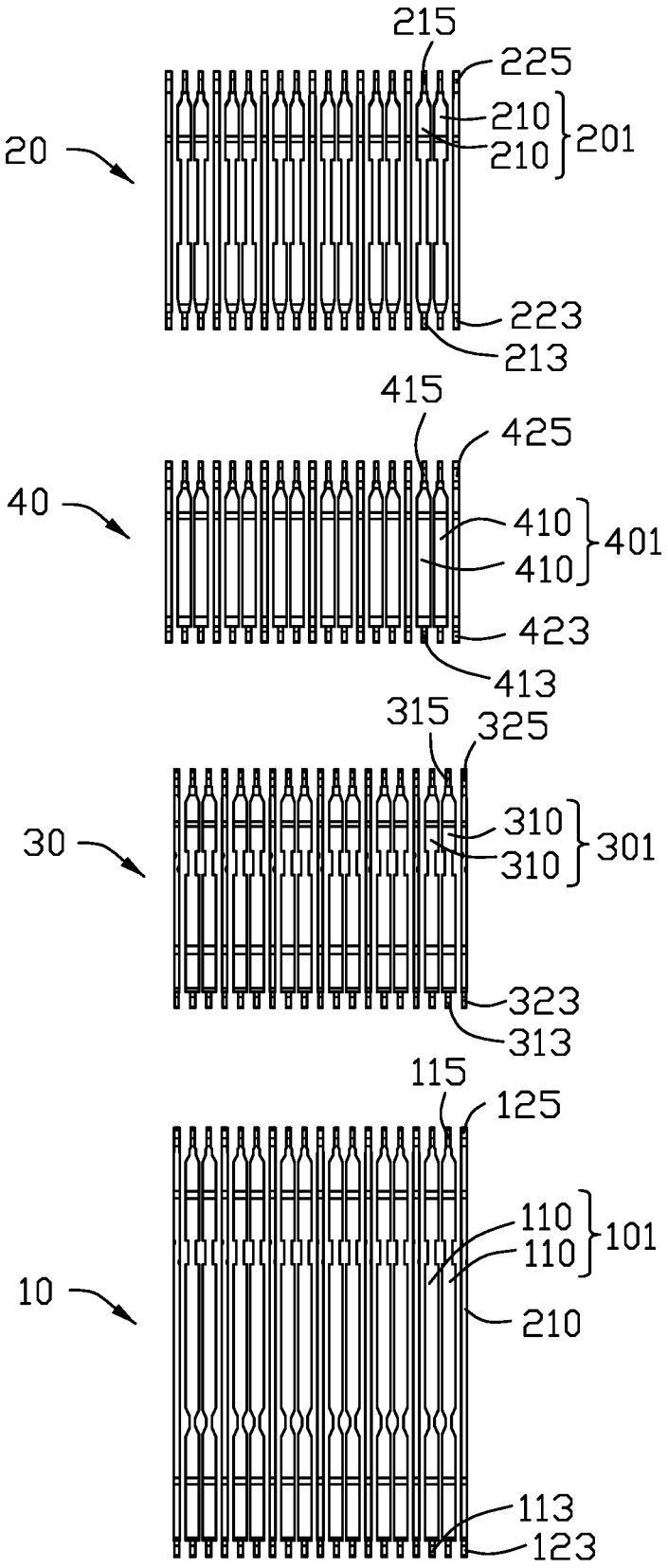
FIG. 12 is a front view of the four rows of terminals in FIG. 10.
Figure 13:
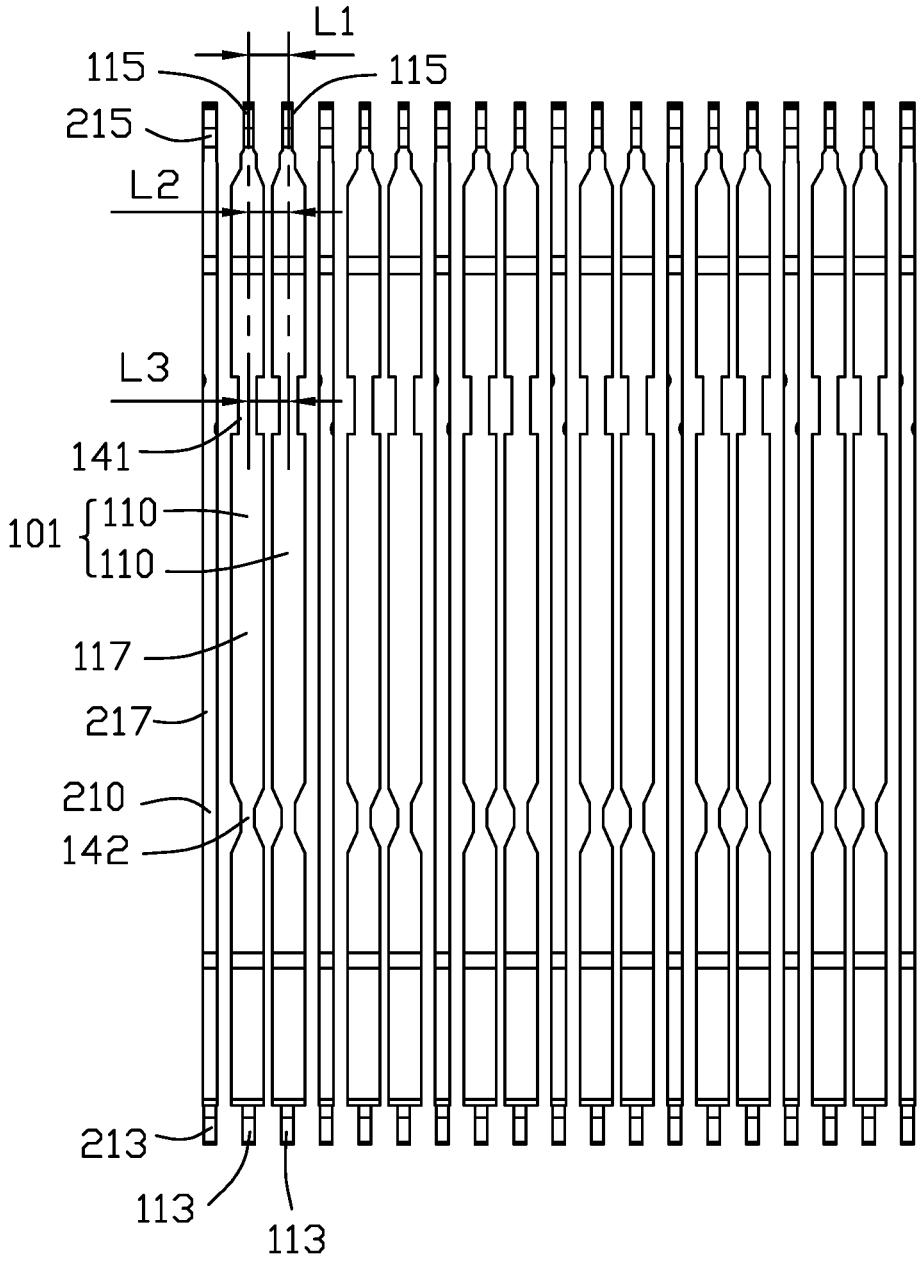
FIG. 13 is a front view of the first rows of terminals in FIG. 10.
Figure 14:
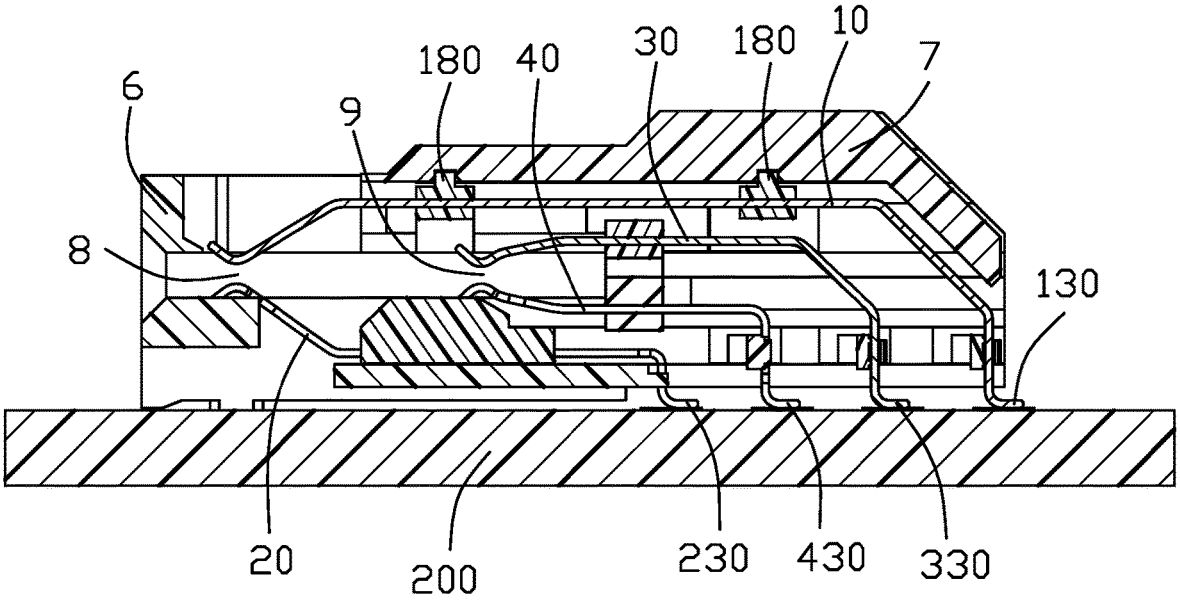
FIG. 14 is a cross-sectional view along line 14-14 of the electrical connector in FIG. 1.
Figure 15:
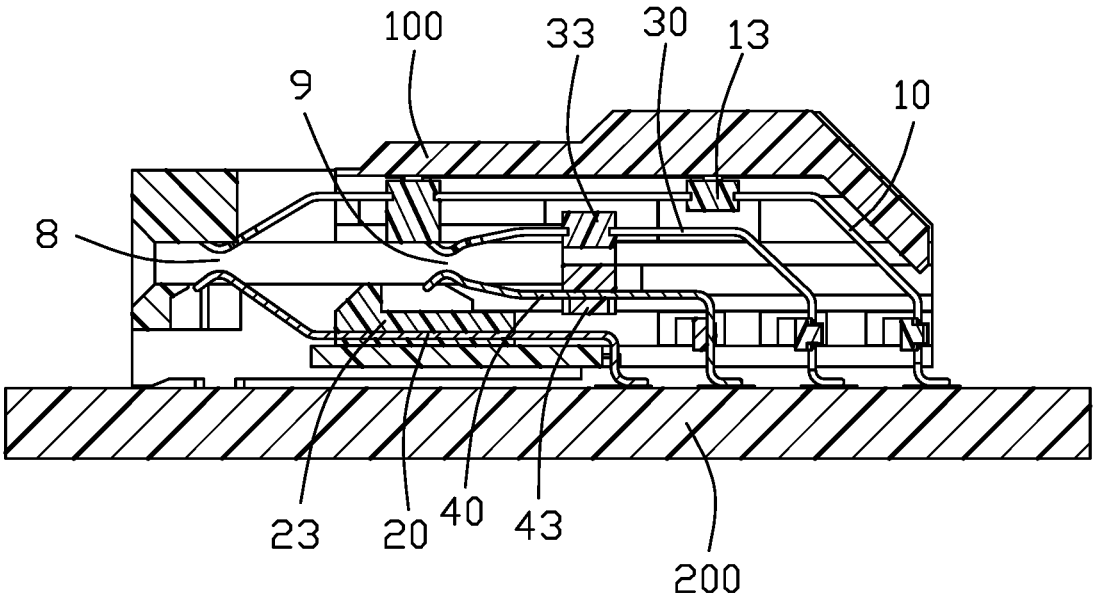
FIG. 15 is a cross-sectional view along line 15-15 of the electrical connector in FIG. 1.

Referring to FIGS. 1-15, an electrical connector 100 of the present invention is used to be mounted on a circuit board 200 and can be mated with a mating connector (not shown). The electrical connector 100 includes an insulating body 50 and a plurality of terminal groups arranged in the insulating body 50. The terminal groups include a first terminal group 1, a second terminal group 2, a third terminal group 3, and a fourth terminal group 4. For ease understanding, in the present invention, the direction in which the electrical connector 100 and the mating connector are mated is defined as the front-rear direction, the direction in which the electrical connector 100 is mounted on the circuit board 200 is defined as the up-down direction, the direction perpendicular to the front-rear direction and the up-down direction is defined as the left-right direction.

The insulating body 50 includes a body portion 6 and an upper cover 7 that cooperates with the body portion 6. The body portion 6 includes a front side 601 that is mated with the mating connector and a rear side 603 opposite to the front side 601. The body portion 6 includes two side walls 61 and a bottom wall 65 connecting the two side walls 61 and arranged at the bottom. The two side walls 61 extend backward beyond the bottom wall 65. The upper part of the body portion 6 is matched with the upper cover 7. Each of the two side walls 61 are respectively provided with a first installation groove 610, a second installation groove 620 located above the first installation groove 610, a third installation groove 630 located above the second installation groove 620, and a forth installation groove 640 located above the third installation groove 630. The upper cover 7 includes a cover body 70 and two mounting portions 71 formed on both sides of the cover body 70, and an inclined oblique pushing portion 73 is provided at the rear of the cover body 70. The lower surface of the cover body 70 is provided with a number of positioning holes 701. The mounting portions 71 is matched with the corresponding fourth installation grooves 640.

The first terminal group 1 includes a first row of terminals 10 arranged in the left-right direction and a first fixing member 13 for fixing the first row of terminals 10. The first row of terminals 10 includes a signal terminal pair 101 capable of transmitting differential signals and a ground terminal 120 provided on one side of the signal terminal pair 101. In this embodiment, the ground terminal 120 and the signal terminal pair 101 are arranged at intervals. The signal terminal pair 101 includes a pair of signal terminals 110. The center distance of the pair of signal terminals 110 is not greater than the center distance of the ground terminal 120 and its adjacent signal terminals 110 in corresponding positions. In the present invention, the center distance refers to the distance between the center line of one terminal and the center line of the corresponding part of the other terminal. Each of the signal terminals 110 includes a tail portion 113 that can be electrically connected to the external circuit board 200, a contact portion 115 mated with a mating connector, and a body portion 117 located between the tail portion 113 and the contact portion 115. The body portion 117 includes a covering part 140 held in the first fixing member 13 and a free part 150 exposed to the air. The width of the free part 150 is greater than the width of the covering part 140. The distance between the contact portions 115 of the pair of signal terminals 110 of the signal terminal pair 101 is a first center distance L1, the distance between the free parts 150 is a second center distance L2, and the distance between the covering parts 140 is the third center distance L3. The second center distance L2 is smaller than the first center distance L1, and the third center distance L3 is greater than the second center distance L2. The third center distance L3 is not greater than the first center distance L1. The body portion 117 includes a horizontal portion 118 extending horizontally rearward from the contact portion 115 and a connecting portion 119 connecting the horizontal portion 118 and the tail portion 113. The connecting portion 119 includes an inclined portion 108 extending obliquely downward and backward, and a vertical portion 109 connecting the inclined portion 108 and the tail portion 113. The covering part 140 includes a first covering portion 141, a second covering portion 142, and a third covering portion 143 arranged at intervals along the length direction. The size and shape of the first covering portion 141, the second covering portion 142, and the third covering portion 143 are different. The first covering portion 141 and the second covering portion 142 are arranged on the horizontal portion 118, and the third covering portion 143 is arranged on the vertical portion 109.

The ground terminal 120 includes a ground tail portion 123 that can be electrically connected to the external circuit board 200, a ground contact portion 125 mated with a mating connector, and a ground body portion 127 between the ground contact portion 125 and the ground tail portion 123. The grounding body portion 127 includes a grounding covering portion 128 covered in the first fixing member 13 and a grounding free portion 129 exposed to the air. The ground covering portion 128 and the ground free portion 129 are aligned with the corresponding covering part 140 and the free part 150 of the signal terminal 110 in the left-right direction. The ground covering portion 128 and the ground free portion 129 have the same width, and the ground body portion 127 has a constant width over the entire length. The width dimension of the ground contact portion 125 is greater than the width dimension of the contact portion 115 of the signal terminal 110. The width dimension of the free part 150 of the signal terminal 110 is at least twice the width dimension of the ground body portion 127. The distance between the free parts 150 of the two signal terminals 110 of the signal terminal pair 101 is smaller than the distance between the signal terminal 110 and the corresponding ground free portion 129 of the adjacent ground terminal 120. The body portion 6 includes a plurality of guide grooves 68 and partition walls 69 separating the guide grooves 68. The guide groove 68 is used to accommodate the contact portion 115 of the signal terminal 110 and the ground contact portion 125 of the ground terminal 120. The partition wall 69 between the ground terminal 120 and the adjacent signal terminal 110 extends backward beyond the partition wall 69 between the signal terminal pair 101.

The first fixing member 13 includes a first fixing part 131 arranged on the first covering portion 141, a second fixing part 132 arranged on the second covering portion 142, and a third fixing part 133 arranged on the third covering portion 143. The length dimension of the free part 150 of the signal terminal 110 is greater than the length dimension of the covering part 140 of the signal terminal 110. The signal terminal 110 is exposed to the air as much as possible to adjust the characteristic impedance of the signal terminal 110, so that the signal terminal 110 can transmit high-speed signals. In this embodiment, along the length direction of the signal terminal 110, the size of the free part 150 accounts for at least 70% of the size of the body portion 117. The first fixing part 131 and the second fixing part 132 of the first fixing member 13 are arranged horizontally, and the third fixing part 133 is arranged vertically. The upper surfaces of the first fixing part 131 and the second fixing part 132 are provided with a plurality of positioning posts 180 that cooperate with the positioning holes 701. The left and right sides of the first fixing part 131 and the second fixing part 132 are provided with first mounting portions 137, the first mounting portion 137 is matched with the third mounting groove 630. The first terminal group 1 and the upper cover 7 are combined with the positioning holes 701 and the positioning posts 180, a forward force is applied to the inclined oblique pushing portion 73 to assemble the first terminal group 1 and the upper cover 7 into the body portion 6. The first fixing part 131 and the second fixing part 132 are integrally formed on the signal terminal 110 and the ground terminal 120, The third fixing part 133 is thermally riveted to the signal terminal 110 and the ground terminal 120.

The second terminal group 2 includes a second row of terminals 20 arranged in the left-right direction and a second fixing member 23 for fixing the second row of terminals 20. The second row of terminals 20 includes a second signal terminal pair 201 for transmitting differential signals and a second ground terminal 220 arranged on one side of the second signal terminal pair 201. The second signal terminal pair 201 includes a pair of second signal terminals 210. Each of the second signal terminals 210 includes a second signal tail portion 213, a second contact portion 215, and a second body portion 217 located between the second signal tail portion 213 and the second contact portion 215. The second body portion 217 includes a second covering portion 240 held in the second fixing member 23 and a second free portion 250 exposed to the air. The second ground terminal 220 includes a second ground tail portion 223, a second ground contact portion 225 mated with the mating connector, and a second ground body portion 227 located between the second ground tail portion 223 and the second ground contact portion 225. The second fixing member 23 is integrally formed to fix the second signal terminal 210 and the second ground terminal 220. There are second mounting portions 237 on the left and right sides of the second fixing member 23, and the second mounting portions 237 are matched with the first installation groove 610. The width dimension of the second free portion 250 of the second signal terminal 210 is at least twice the width dimension of the second ground body portion 227.

The third terminal group 3 includes a third row of terminals 30 arranged in the left-right direction and a third fixing member 33 fixed to the third row of terminals 30. The third row of terminals 30 includes a third signal terminal pair 301 for transmitting differential signals and a third ground terminal 320 arranged on one side of the third signal terminal pair 301. The third signal terminal pair 301 includes a pair of third signal terminals 310. The third row of terminals 30 includes a third tail portion 330 that can be soldered on the circuit board 200, and the third fixing member 33 includes a third front fixing member 331 and a third rear fixing member 333 arranged at intervals between the front and rear. The third rear fixing member 333 is close to the third tail 330. The third front fixing member 331 is integrally formed on the third signal terminal 310 and the third ground terminal 320. The third rear fixing member 333 is thermally riveted to the third signal terminal 310 and the third ground terminal 320. The left and right sides of the third front fixing member 331 are provided with third mounting portions 337, and the third mounting portions 337 are matched with the third mounting grooves 630.

The fourth terminal group 4 includes a fourth row of terminals 40 arranged in the left-right direction and a fourth fixing member 43 arranged on the fourth row of terminals 40. The fourth row of terminals 40 includes a fourth signal terminal pair 401 for transmitting differential signals and a fourth ground terminal 420 arranged on the side of the fourth signal terminal pair 401. The fourth signal terminal pair 401 includes a pair of fourth signal terminals 410. The fourth row of terminals 40 includes a fourth tail portion 430 that can be soldered on the circuit board 200. The fourth fixing member 43 includes a fourth front fixing member 431 and a fourth rear fixing member 433 that are spaced apart from each other. The fourth rear fixing member 433 is close to the fourth tail 430 portion. The fourth front fixing member 431 is integrally formed on the fourth signal terminal 410 and the fourth ground terminal 420. The fourth rear fixing member 433 is thermally riveted to the fourth signal terminal 410 and the fourth ground terminal 420. The left and right sides of the fourth front fixing member 431 are provided with fourth mounting portions 437, and the fourth mounting portion 437 is matched with the third mounting groove 630.

Along the length direction, the size of the first terminal group 1 is the largest. The first row of terminals 10 of the first terminal group 1 and the second row of terminals 20 of the second terminal group 2 form a first mating port 8. The third terminal group 3 and the fourth terminal group 4 form a second mating port 9. The first mating port 8 and the second mating port 9 are arranged in the front-to-back direction, and are used to mate to the same mating connector. The first terminal group 1 and the upper cover 7 are assembled together and assembled into the body portion 6 from back to front. The second terminal group 2, the third terminal group 3, and the fourth terminal group 4 are all mounted on the body portion 6 from back to front. The second mounting portion 237 of the second terminal group 2 is mounted to the first installation groove 610, the fourth mounting portion 437 of the fourth terminal group 4 is mounted to the second installation groove 620. The third mounting portion 337 of the third terminal group 3 and the first mounting portion 137 of the first terminal group 1 are both mounted into the third installation groove 630. The mounting portion 71 of the upper cover 7 is matched with the fourth installation groove 640. The tail portion 113 of the signal terminal 110 and the ground tail portion 123 of the ground terminal are arranged in the left-right direction to form a first tail portion 130. The second signal tail portion 213 of the second signal terminal 210 and the second ground tail portion 223 of the second ground terminal 220 are arranged in the left-right direction into a second tail 230. The third terminal group 3 includes a third tail 330, and the fourth terminal group 4 includes a fourth tail 430. After the terminal groups are assembled into the body portion 6, the second tail portion 230, the fourth tail portion 430, the third tail portion 330, and the first tail portion 130 are arranged in order from front to back.

The assembling method of the electrical connector 100 includes the following steps: provide the body portion 6; provide the upper cover 7; provide the first terminal group 1, the second terminal group 2, the third terminal group 3, and the fourth terminal group 4; install the second terminal group 2 in the first installation groove 610 of the body portion 6 from back to front, install the fourth terminal group 4 into the second installation groove 620 of the body portion 6 from back to front; partially install the whole formed by the first terminal group 1 and the upper cover 7 in the third installation groove 630 and the fourth installation groove 640 of the body portion 6 from back to front, the first terminal group 1 is matched with the third installation groove 630, and the upper cover 7 is matched with the fourth installation groove 640; install the third terminal group 3 in the third installation groove 630 from the back to front; the whole of the first terminal group 1 and the upper cover 7 is further assembled to a predetermined position from back to front.

The electrical connector of the present invention through the change of the center distance between a pair of signal terminals of the signal terminal pair; expose the signal terminal to the air as much as possible to adjust the characteristic impedance of the signal terminal thereby improve the signal transmission rate of electrical connector, and the electrical connector of the present invention first assembles the upper cover and the first terminal group together, and then assembles into the body part, Install the longer first terminal group into the body part through the upper cover, making the structure of the electrical connector more compact, the assembly is simple and convenient, and the cost of the electrical connector is reduced. The electrical connector 100 of this embodiment conforms to the QSFP-DD specification, which defines 8 transmitting channels and 8 receiving channels, and the signal transmission rate of each channel can reach 100 Gbps. The present invention can also be applied to SFP-DD, SFP, OSFP and similar high-speed electrical connectors.

What is claimed is:

1. An electrical connector for mating with a mating connector, comprising:

an insulating body;

a first terminal group housed in the insulating body and including a first row of terminals and a first fixing member for fixing the first row of terminals, the first row of terminals including a signal terminal pair capable of transmitting differential signals and a ground terminal arranged on one side of the signal terminal pair, the signal terminal pair including a pair of signal terminals, each of the signal terminals including a tail portion, a contact portion for mating with the mating connector, and a body portion located between the tail portion and the contact portion, the body portion including a covering portion provided in the first fixing member and a free portion exposed to air, there being a first center distance between the contact portions of the signal terminal pair, there being a second center distance between the free portions of the body portions, there being a third center distance between the covering portions of the body portions; and a second terminal group housed in the insulating body and including a second row of terminals, the first row of terminals and the second row of terminals forming a first mating port; wherein the second center distance is smaller than the first center distance, and the third center distance is greater than the second center distance;

a center distance between the pair of signal terminals is not greater than a center distance between the ground terminal and an adjacent signal terminal at corresponding positions;

the ground terminal includes a tail portion, a contacting portion for mating with the mating connector, and a body portion between the contacting portion and the tail portion, and a width of the ground terminal body portion in the entire length direction is constant; and the insulating body includes a plurality of guide grooves for accommodating the signal terminal contact portions and the ground terminal contact portions and a partition wall separating each of the guide grooves, the partition wall between the ground terminal and adjacent signal terminal extends backward beyond the artition wall between the two signal terminals of the signal terminal pair.

2. The electrical connector as claimed in claim 1, wherein the third center distance is less than the first center distance.

3. The electrical connector as claimed in claim 1, wherein a length of the free portion accounts for at least 70% of a length of the body portion.

4. The electrical connector as claimed in claim 1, wherein a width of the free portion of the signal terminal is greater than a width of the covering portion.

5. The electrical connector as claimed in claim 4, wherein the covering portion includes a first covering portion, a second covering portion, and a third covering portion arranged at intervals along a length direction of the terminal.

6. The electrical connector as claimed in claim 5, wherein the body portion includes a horizontal portion extending horizontally rearward from the contact portion and a connecting portion connecting the horizontal portion and the tail portion, the first covering portion and the second covering portion are disposed on the horizontal portion, and the third covering portion is arranged on the connecting portion.

7. The electrical connector as claimed in claim 6, wherein the first fixing member includes a first fixing part arranged on the first covering portion, a second fixing part arranged on the second covering portion, and a third fixing part arranged on the third covering portion, the first fixing part is integrally formed on the first covering portion, the second fixing part is integrally formed on the second covering portion, and the third fixing part is thermally riveted to the third covering portion.

8. An electrical connector for mating with a mating connector, comprising:

an insulating body including a body portion and an upper cover matched with the body portion, the body portion including a front side facing the mating connector at the front and a rear side opposite to the front side;

a first terminal group housed in the insulating body;

a second terminal group housed in the insulating body, the first terminal group and the second terminal group forming a first mating port;

a third terminal group housed in the insulating body; and a forth terminal group housed in the insulating body, the third terminal group and the fourth terminal group forming a second mating port, the first mating port and the second mating port being arranged in a front-to-rear direction for mating to the mating connector, the size of the first terminal group along a lengthwise direction is larger than the size of either one of the second terminal group, the third terminal group, and the fourth terminal group; wherein the first terminal group and the upper cover are first assembled together and then installed forwardly in the body portion from the rear side;

the first terminal group includes a first row of terminals and a first fixing member for fixing the first row of terminals;

the first fixing member is provided with a plurality of positioning posts, and the upper cover is provided with a plurality of positioning holes matched with the positioning posts;

the first fixing member includes a horizontal first fixing part and a horizontal second fixing part, and a vertical third fixing part, and the positioning posts are arranged on the first fixing part and the second fixing part;

the first terminal group the second terminal group, the third terminal group, and the fourth terminal group are all mounted forwardly on the body portion from the rear side;

the first terminal group includes a first tail, the second terminal group includes a second tail, the third terminal group includes a third tail, the fourth terminal group includes a fourth tail, and the second tail, the fourth tail, the third tail, and the first tail are arranged in sequence from front to back; and the body portion includes left and right side walls, the inner surface of each side wall is rovided with a first installation roove a second installation roove above the first installation groove, a third installation groove above the second installation groove, and a fourth installation groove above the third installation groove, the second terminal group is matched with the first installation groove, the fourth terminal group is matched with the second installation groove, the third terminal group and the first terminal group are both matched with the third installation groove, and the upper cover is matched with the fourth installation groove.

* * * * *